US007079032B2

(12) United States Patent
Merrem et al.

(10) Patent No.: US 7,079,032 B2
(45) Date of Patent: Jul. 18, 2006

(54) PORTABLE ELECTRONIC DEVICE PHYSICAL SECURITY APPARATUS WITH ALARMED CABLE

(75) Inventors: Ralph Merrem, San Francisco, CA (US); John Cavacuiti, North Vancouver (CA)

(73) Assignee: ACCO Brands USA LLC, Lincolnshire, IL (US)

( * ) Notice: Subject to any disclaimer, the term of this patent is extended or adjusted under 35 U.S.C. 154(b) by 117 days.

(21) Appl. No.: 10/810,047

(22) Filed: Mar. 25, 2004

(65) Prior Publication Data

US 2005/0035859 A1 Feb. 17, 2005

Related U.S. Application Data

(60) Provisional application No. 60/458,716, filed on Mar. 27, 2003.

(51) Int. Cl.
*G08B 13/12* (2006.01)
*G08B 13/14* (2006.01)

(52) U.S. Cl. ..... 340/568.2; 70/58

(58) Field of Classification Search ..... 340/568.2, 340/568.1, 568.4, 542, 548, 596, 432; 70/58
See application file for complete search history.

(56) References Cited

U.S. PATENT DOCUMENTS

| | | | | |
|---|---|---|---|---|
| 3,596,265 | A | 7/1971 | Garland | |
| 3,898,641 | A | 8/1975 | Banner | |
| 4,620,182 | A | 10/1986 | Keifer | |
| 4,654,640 | A | 3/1987 | Carll et al. | |
| 4,878,045 | A | 10/1989 | Tanaka et al. | |
| 4,896,140 | A | 1/1990 | Biever et al. | |
| 5,066,942 | A | 11/1991 | Matsuo | |
| 5,327,752 | A | 7/1994 | Myers et al. | |
| 5,570,080 | A | 10/1996 | Inoue et al. | |
| 5,610,587 | A * | 3/1997 | Fujiuchi et al. | 340/568.2 |
| 5,889,463 | A | 3/1999 | Judd et al. | |
| 5,960,651 | A * | 10/1999 | Tanisawa | 70/14 |
| 6,087,939 | A | 7/2000 | Leyden et al. | |
| 6,150,940 | A | 11/2000 | Chapman et al. | |
| 6,262,664 | B1 | 7/2001 | Maloney | |
| 6,300,874 | B1 | 10/2001 | Rand | |
| 6,389,853 | B1 * | 5/2002 | Pate et al. | 70/18 |
| 6,389,854 | B1 | 5/2002 | Huang | |
| 6,598,433 | B1 * | 7/2003 | Malvasio | 70/18 |
| 6,621,415 | B1 * | 9/2003 | Willis | 340/568.2 |
| 6,933,847 | B1 * | 8/2005 | Feibelman | 340/572.1 |

* cited by examiner

*Primary Examiner*—John Tweel, Jr
(74) *Attorney, Agent, or Firm*—Townsend and Townsend and Crew LLP

(57) ABSTRACT

A security device for preventing removal and theft of valuable devices includes an alarm that is coupled to a cable. At a distal end of the cable, a locking device is provided. The locking device is coupled to a valuable device. The other end of the cable is coupled to the alarm. The alarm includes a power source. A lock plate is placed over the power source. The cable is routed through the alarm and through the lock plate prior to coupling the locking device to the portable electronic device. With the cable through the alarm and the lock plate, the lock plate cannot be removed and thus, the power source is inaccessible. A wire loop runs through the cable and is coupled to the alarm such that if the cable is cut, the circuit is broken and the alarm sounds.

17 Claims, 12 Drawing Sheets

PORTABLE ELECTRONIC DEVICE PHYSICAL SECURITY APPARATUS WITH ALARMED CABLE

CROSS-REFERENCES TO RELATED APPLICATIONS

This application is a non-provisional application and claims the benefit of Application No. 60/458,716, filed Mar. 27, 2003, entitled "PORTABLE ELECTRONIC DEVICE PHYSICAL SECURITY APPARATUS WITH ALARMED CABLE", which disclosure is incorporated herein by reference for all purposes.

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

The present invention relates to an apparatus and method for inhibiting the theft of small and portable devices that have a relatively high economic value, specifically portable electronic devices having a rigid wall, and more particularly, to an apparatus and method for inhibiting the theft of small and portable devices, wherein the apparatus includes an alarm.

Computers and electronic devices have evolved rather rapidly from large, expensive machines usable only by a few, to relatively small, portable devices which are usable by many. In particular, the development of desk top computers with significant processing power has made computers available to the general population. It is now common for students of all ages to have their own computer, and desk top computers are in wide spread use as word processors and work stations in almost all forms of business. Desk top computers are relatively small and easily transportable, and an undesirable side effect of their proliferation is the fact that the theft of such computers is a significant problem. A variety of devices have been developed to inhibit the theft of desk top computers, notebook or laptop computers, and similar equipment. Since desk top computer systems involve several components, typically including the computer itself, a separate monitor, keyboard and often a printer, such security systems often employ a cable which attaches each of the components to each other and to a relatively immovable object such as a desk.

The theft of small but expensive equipment such as desk top computers, notebook or laptop computers, and similar equipment continues to be a growing problem. Preexisting devices were simply too inefficient or ineffective, or their application was too limited. As a result, the use of such security systems is rare, computer equipment is typically left unprotected, and it is all too often stolen.

Advancements in the state of the art of electronic devices have led to smaller yet more powerful devices. For example, computers have evolved from very large machines to relatively small, portable, or even hand-held machines. The use of many different types of so-called "lap-top" computers and the smaller hand-held "personal digital assistants" (PDAs) has proliferated within personal, educational and business environments. However, an undesirable side effect of ever-shrinking electronic devices is the easy access and asportation by others, especially thieves or others desiring unauthorized use of the electronic device.

Thus, many styles of security devices have been developed. Many of these include a locking device that attaches to the portable electronic device. The locking device is coupled to a cable that is secured or generally "wrapped" around an immovable object.

Sometimes, in order to steal a portable electronic device, one will cut the cable since the locking device can be very difficult to remove. In fact, this has become more commonplace in recent years.

BRIEF SUMMARY OF THE INVENTION

The present invention provides a security device that includes an alarm that is coupled to a cable. At a distal end of the cable, a locking device is provided. The locking device is coupled to an electronic device. The other end of the cable is coupled to the alarm. The alarm includes a power source. A lock plate is placed over the power source. The cable is routed through the alarm and through the lock plate prior to coupling the locking device to the portable electronic device. With the cable through the alarm and the lock plate, the lock plate cannot be removed and thus, the power source is inaccessible. A wire loop runs through the cable and is coupled to the alarm such that if the cable is cut, the circuit is broken and the alarm sounds.

In accordance with one aspect of the present invention, the alarm is always on.

In accordance with another aspect of the present invention, the alarm includes a low battery indicator.

In accordance with a further aspect of the present invention, the lock plate slides relative to the housing.

In accordance with another aspect of the present invention, the lock plate rotates relative to the housing.

In accordance with a further aspect of the present invention, the battery level indicator comprises at least one LED.

In accordance with yet another aspect of the present invention, the battery level indicator produces a sound emission.

In accordance with yet another aspect of the present invention, the locking device is configured for coupling to a security slot defined within a wall of the portable electronic device.

In accordance with a further aspect of the present invention, the security slot has dimensions of approximately 3 mm by 7 mm.

The present invention also provides a method of securing an electronic device with a security device comprising an alarm, including a housing, a cable coupled to the housing and including a wire therein for completing an alarm circuit, and a locking device coupled to a distal end of the cable. The method comprises aligning an opening defined within a lock plate of the alarm with an opening defined within the housing, passing the cable around a secondary object, passing the locking device through the aligned openings, inserting a locking member of the locking device into a security slot defined within the portable electronic device, misaligning the locking member with respect to the security slot into a locked position such that it cannot be removed from the security slot, and maintaining the locking member in the locked position with at least one pin.

The novel features which are characteristic of the present invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE INVENTION

The present invention discloses a security device that includes an alarm for preventing removal or theft of valuable apparatuses, especially electronic devices and especially, portable electronic devices. Three examples of preferred embodiments of locking devices for use with the security device in accordance with the present invention will be described. However, those skilled in the art will understand that there are numerous other embodiments that may be used and thus, the following description of the three embodiments is not meant to be limiting or restrictive in any way.

Figure 1:
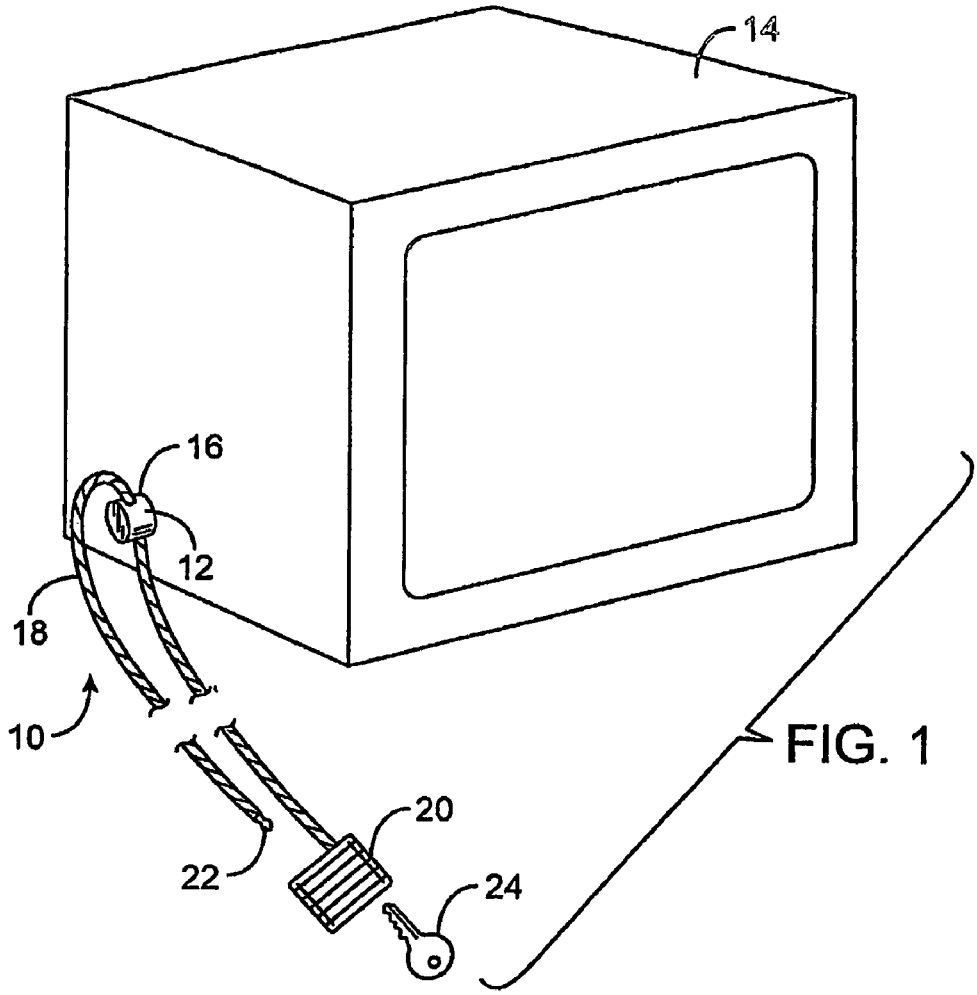
FIG. 1 is a perspective view of an example of a first embodiment of a locking device for a security device for use with the present invention attached to a computer monitor.

A first embodiment of a locking device 10 of the security device of the present invention is illustrated generally by way of reference to FIG. 1. Security device 10 includes a locking device 12 designed to attach to a component of a computer system, such as computer monitor 14. Locking device 12 has an aperture 16, and a cable 18 which passes through the aperture when the locking device 12 is attached to a component such as monitor 14. A lock 20 is fixed to one end of cable 18. The free end of cable 18 may be of the type having a "mushroom" head 22 adapted to penetrate and be secured within lock 20 using key 24. With mushroom head 22 detached from lock 20, cable 18 can be threaded through the apertures 16 of one or more locking devices 12, and wrapped around a relatively immovable object (not shown) such as the cross bar spanning two legs of a desk. Mushroom head 22 is then inserted into lock 20 and the lock closed using key 24 to secure the computer components to the immovable object.

Figure 2:
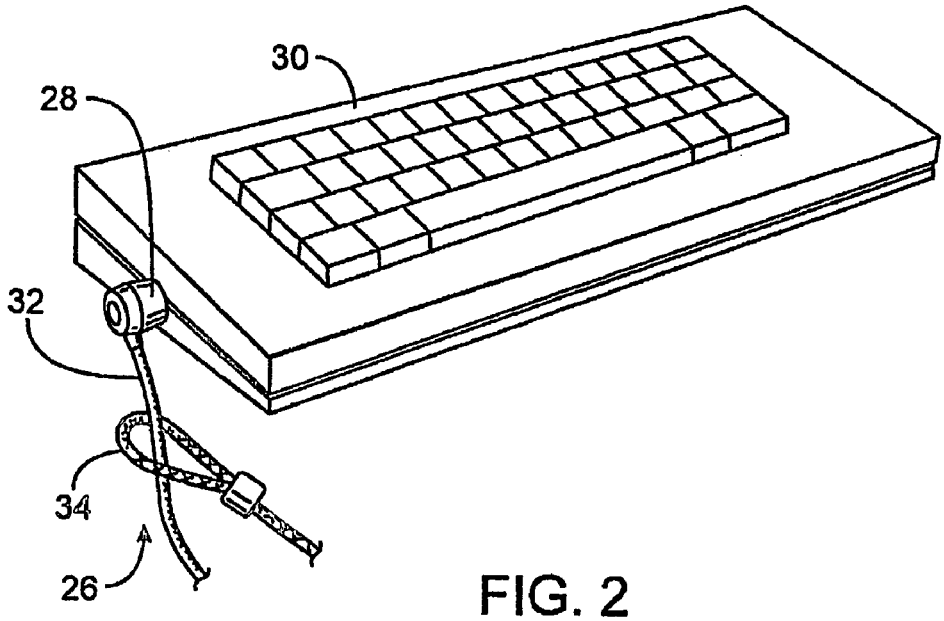
FIG. 2 is a perspective view of an example of a second embodiment of a locking device for a security device for use with the present invention attached to a computer keyboard.

A second embodiment 26 of the present invention, designed primarily to secure single rather than multiple items of computer equipment, is illustrated generally by way of reference to FIG. 2, Embodiment 26 includes a locking device 28 designed to be secured to a computer component such as keyboard 30. Locking device 28 is affixed to one end of a cable 32 which has a closed loop 34 at its other end. Cable 32 is first wrapped around a relatively immovable object, such as a cross piece between two legs of a desk or table, and locking device 28 is passed through loop 34 and attached to the item to be protected such as keyboard 30 to make it difficult to steal the item of equipment.

Figure 4:
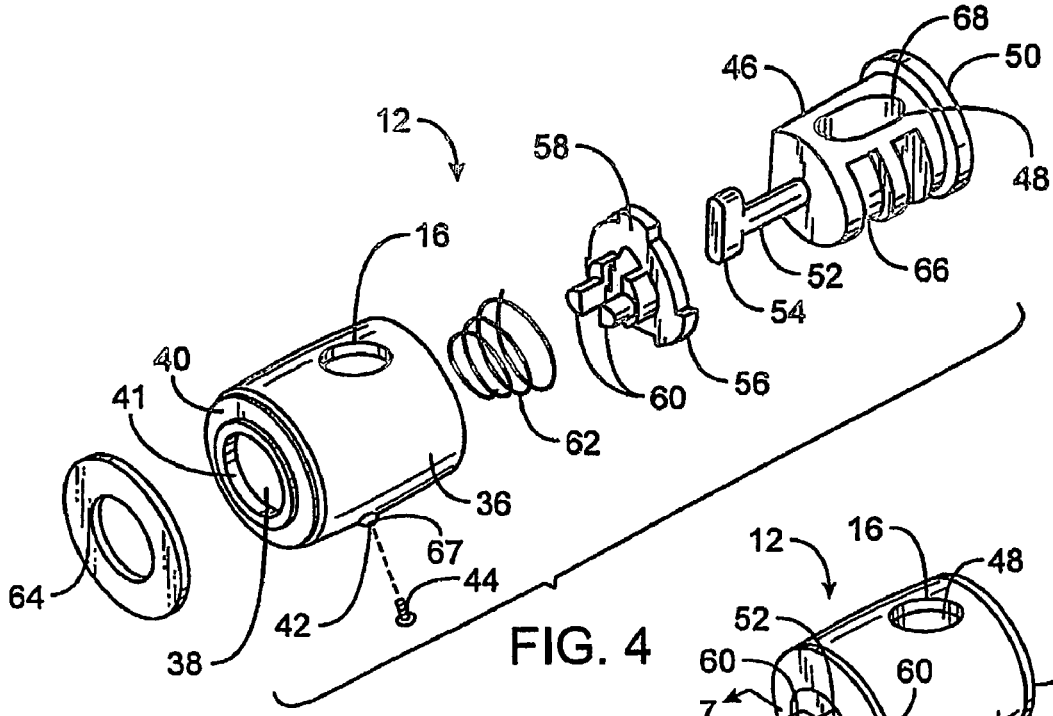
FIG. 4 is an exploded view of the locking device of FIG. 3.
Figure 3:
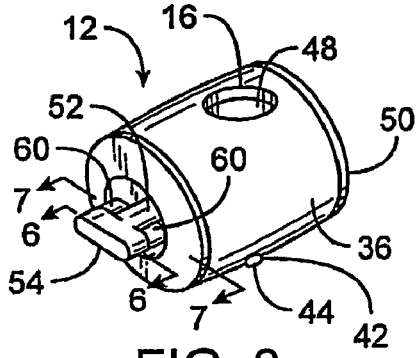
FIG. 3 is a perspective view of the locking device of the first embodiment.

Locking device 12 of first embodiment 10 is illustrated in more detail by way of reference to FIGS. 3 and 4 in combination. Mechanism 12 includes a housing 36 having a hollow interior cylindrical cavity 38. An annular plate 40 forms one end of housing 36 and has an aperture 41. A pair of apertures such as aperture 16 are located on opposite sides of housing 36. A small raised aperture 42 is also provided in housing 36 to accommodate a pin 44, as explained in more detail hereinafter.

A spindle 46 includes a cylindrical portion 48 adapted to fit within the cylindrical cavity of housing 36. Spindle 48 includes a raised plate 50 at one end which forms the aft end of the mechanism when assembled as illustrated in FIG. 3. Spindle 46 also includes a shaft 52 extending outwardly through the aperture 41 in housing 36. A crossmember 54 is located on the distal end of shaft 52.

An abutment mechanism 56 includes an abutment plate 58 designed to be received within the cylindrical interior cavity of housing 36, and a pair of pins 60 adapted to extend outwardly through the aperture 41 in housing 36. A spring 62 biases abutment plate 58 and spindle 46 rearwardly when the mechanism is assembled, as illustrated in FIG. 3. A plastic bushing 64 designed to prevent scarring of the equipment to which mechanism 12 is attached is affixed to the plate 40 on housing 36 circumscribing aperture 41.

When mechanism 12 is assembled as illustrated in FIG. 3, crossmember 54 and shaft 52, together with pins 60 on either side of the shaft, extend outwardly beyond housing 46 through aperture 41. Pin 44 engages a groove 66 in spindle 46 so that the mechanism cannot be disassembled without removing the pin. The head of pin 44 is conformed to the shape of a boss 67 on the surface of housing 36 so that the pin cannot be removed without special equipment. Groove 66 has a preselected width allowing limited axial movement of spindle 46 relative to housing 36 with pin 44 engaged so that the axial position of crossmember 54 relative to the housing is somewhat adjustable. Spring 62 biases plate 58 and spindle 46 rearwardly to bias crossmember 54 toward housing 36.

Groove 66 extends around about 25% of the periphery of spindle 46 so that the spindle can be rotated approximately 90° relative to the housing. A transverse aperture 68 through the cylindrical portion 48 of spindle 46 is aligned with aperture 16 in housing 36 when crossmember 54 is misaligned from pin 60 (see FIG. 4). With spindle 46 rotated 90°, as allowed by pin 44 in groove 68, crossmember 54 is aligned with pin 60, and aperture 68 is not aligned with aperture 16. Cable 18 (see FIG. 1) can only be inserted through the aligned apertures 16, 68 when crossmember 54 is misaligned with pins 60, i.e., when locking device 12 is attached to the piece of equipment, as explained hereinbelow. With cable 18 passing through aligned apertures 16 and 68, rotation of spindle 46 so as to align crossmember 54 with pins 60 and allow removal of the locking device is effectively prevented.

Figure 5:
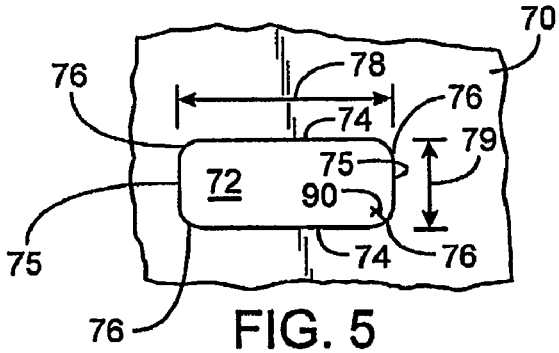
FIG. 5 is a fragmentary elevation view of a slot in a piece of equipment specially designed to accept the locking device of either embodiment of the present invention.

The preferred embodiments 10 and 26 of the present invention are designed to operate with items of equipment provided by a special slot, as illustrated in FIG. 5. The exterior wall 70 of the piece of equipment is typically made of sheet metal, or molded plastic, either of which is compatible with the present invention. A relatively small slot 72 is formed in wall 70, by molding or otherwise as appropriate. In the preferred embodiment of slot 72, the slot has a generally rectangular configuration, i.e., the slot is generally rectangular having long parallel sides 74, short parallel sides 75 and rounded comers 76. Slot 72 is relatively small, having a long dimension 78 of seven millimeters, and a short dimension 79 of three millimeters, in the preferred embodiment of the present invention. Comers 76 have a radius of curvature 90 from 0.30 mm. to a maximum of 1.5 millimeters. If the radius of curvature 90 is 1.5 mm., the short sides 75 disappear and the slot has a straight-sided oval configuration.

Figure 6:
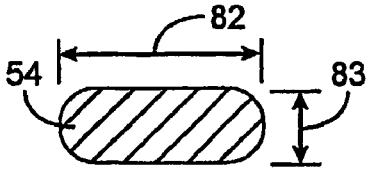
FIG. 6 is a section view taken along lines 6—6 of FIG. 3.
Figure 7:
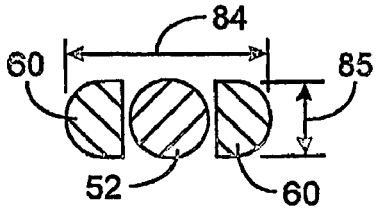
FIG. 7 is a section view taken along lines 7—7 of FIG. 3.

The peripheral dimensions of crossmember 54 are closely conformed to the interior dimensions of slot 72, as illustrated in FIG. 6. The crossmember 4 of locking device 12 has a straight-sided oval configuration, i.e., the crossmember is generally rectangular, having straight sides and semi-circular ends. In the preferred embodiment, the long dimension 82 of crossmember 54 is 6.75 millimeters, while the short dimension 83 is 2.75 millimeters, each being slightly less than the corresponding dimension of slot 72. As illustrated in FIG. 7, the peripheral dimensions of the pins 60 and shaft 52 also closely conform to the interior dimensions of slot 72. As with crossmember 54, pins 60 in shaft 52 have a long dimension 84 of 6.75 millimeters, and a short dimension 85 of 2.75 millimeters.

Figure 8:
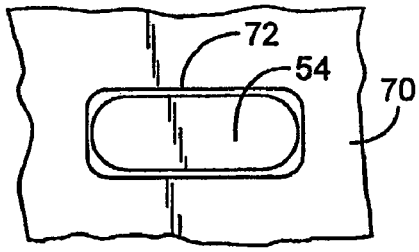
FIG. 8 is a fragmentary section view from inside an item of equipment illustrating insertion of a crossmember of the embodiment of FIG. 3 into the slot of FIG. 5.
Figure 10A:
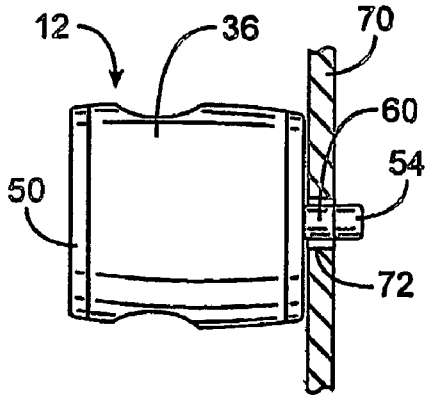
FIGS. 10A and B are elevation views illustrating the installation of the locking device of FIG. 3 on an item of equipment.

The insertion of crossmember 54 of locking device 12 into slot 72 of external wall 70 is illustrated by reference to FIGS. 8 and 10A. Before insertion, spindle 46 must be rotated so that crossmember 54 is aligned with pins 60, as illustrated in FIG. 3. With the spindle in this position, the periphery of crossmember 54 and that of pins 60 and shaft 52 are essentially congruent. Since the peripheral dimension of crossmember 54 and pins 60 and shaft 52 in combination are less than the dimensions of slot 72, the crossmember can be inserted through the slot until crossmember 54 is completely inside wall 70 (see FIG 10A). If necessary, the plate 50 on spindle 46 can be pressed to compress spring 62 so that crossmember 54 is completely inside wall 70.

Figure 9:
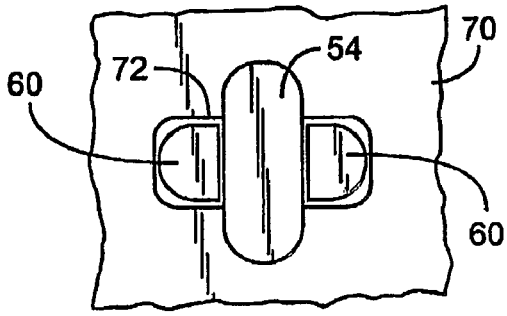
FIG. 9 is a view similar to that of FIG. 8 with the crossmember misaligned.

As illustrated in FIG. 9, upon insertion of crossmember 54 completely through slot 72, the spindle is rotated by manipulating plate 50 so that crossmember 54 is 90° misaligned with respect to pins 60. The aperture 16 in the side wall of housing 36 will be aligned with the aperture 68 in the spindle, providing a passageway completely through the housing. In this configuration, cable 18 can easily be threaded through the aperture, and the presence of the cable prevents the spindle from being rotated back so as to disengage crossmember 54 from slot 72.

Figure 12:
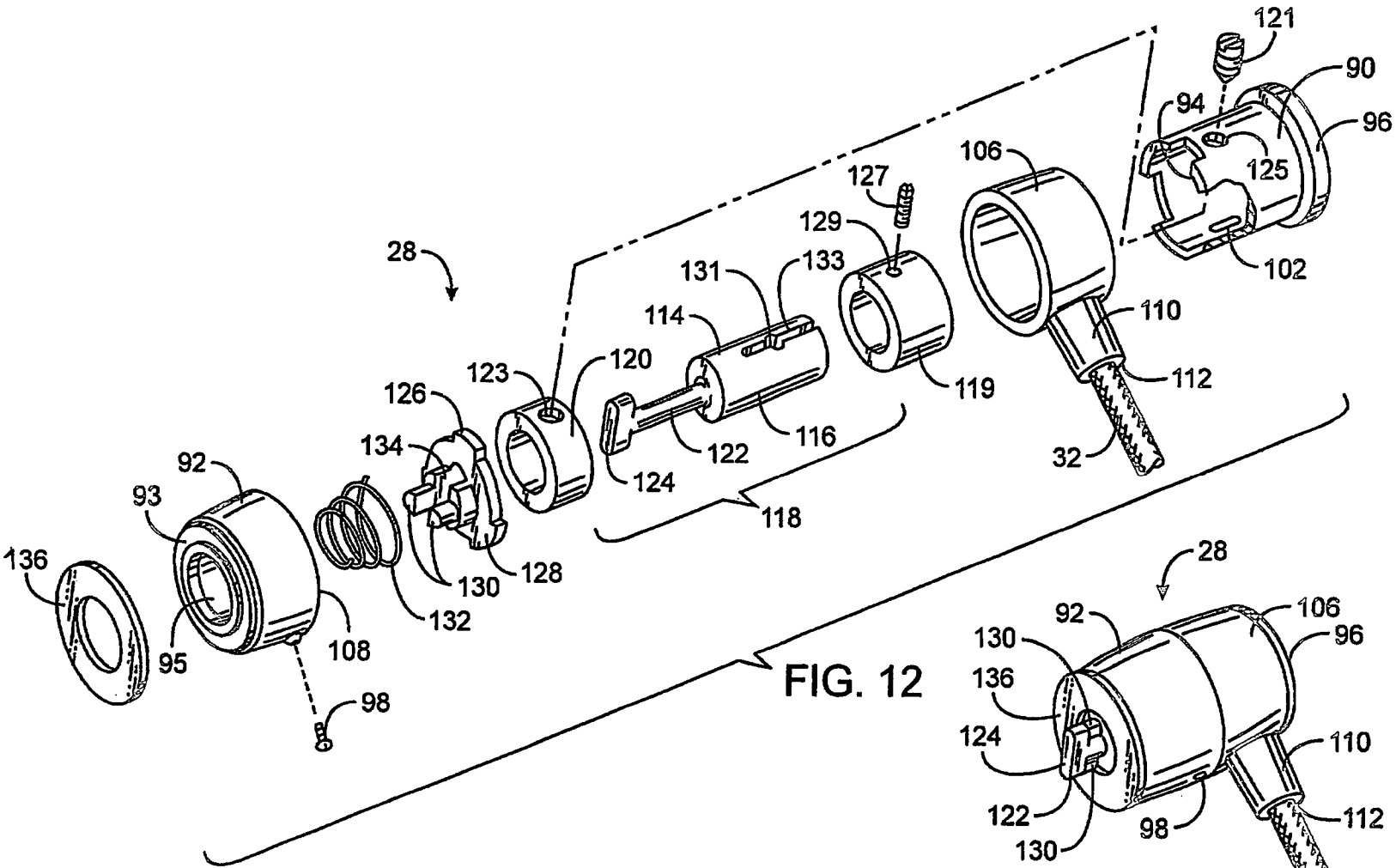
FIG. 12 is an exploded view of the locking device of FIG. 10.
Figure 11:
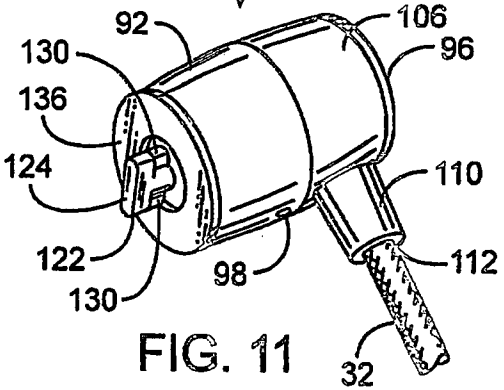
FIG. 11 is a perspective view of the locking device of the second embodiment of the present invention.

The locking device 28 of the second embodiment 26 of the present invention is illustrated in more detail by way of reference to the perspective view of FIG. 11 and the exploded view of FIG. 12. Locking device 28 includes a hollow shell 90 and a nose-piece 92 which, in combination, form a housing. Shell 90 has a hollow cylindrical interior cavity 94, and an integral apertured plate 96 at one end. A pin 98 is inserted through an aperture (not shown) in nose-piece 92 to engage a slot 102 in shell 90. Pin 98 is designed to shear when torque is applied to nose-piece 92 so that an unauthorized attempt to remove the locking device will simply shear the pin and allow the nose-piece to freely rotate without degrading the attachment of the locking device to the component to be protected. Slot 102 is axially elongate so that limited axial movement is allowed between shell 90 and nose-piece 92. The forward end of nose-piece 92 has a plate 93 having a central aperture 95.

A cylindrical collar 106 circumscribes the outer portion of shell 90 and occupies the slot laterally defined by plate 96 and the aft surface 108 of nose-piece 92. Collar 106 has an integral tab 110 with an aperture 112 adapted to receive one end of cable 32. Cable 32 is dead-ended into tab 110 and attached so that it cannot be removed.

A spindle 114 has a cylindrical portion 116 adapted to be received within a cylindrical lock 118 in shell 90. Cylindrical lock 118 includes a front cylinder 119, and a back cylinder 120. A blunt pin or set screw 121 is inserted through an aperture 125 in shell 90, and through a corresponding aperture 123 in back cylinder 120, to lock the front cylinder rotationally with respect to shell 90. Correspondingly, pin or set screw 127 engages a relatively smaller aperture 129 in front cylinder 119, and a widening 131 in slot 133 in the cylindrical portion 116 of spindle 114. Front cylinder 119 is thus fixed rotationally with respect to spindle 114.

As with conventional cylindrical locks, a plurality of pins normally span the interface between front cylinder 119 and back cylinder 120 so that the cylinders are rotationally locked together, thus preventing relative rotation between locking shell 90 and spindle 114. However, a key 140 (see FIG. 13B) is insertable through the apertured plate 96 of shell 90 to engage front cylinder 119. The correct key will have bosses located to depress the pins passing between cylinders 119 and 120 so that such pins do not span the interface between the cylinders, allowing the cylinders to rotate with respect to one another. In this fashion, spindle 114 can be rotated with respect to shell 90 only upon insertion and rotation of the appropriate key.

Spindle 114 also includes a shaft 122, and a crossmember 124 at the free end of the shaft. An abutment mechanism 126 has an abutment plate 128 adapted to fit within nose-piece 92, and a pair of pins 130 adapted to extend outwardly through aperture 95. A spring 132 is located between abutment plate 128 and nose-piece 92 to bias the cylindrical portion 116 of spindle 114 and the abutment plate rearwardly. Abutment plate 126 has an elongate aperture 134 which allows crossmember 124 to extend through the aperture plate. A plastic bushing 136 is fixed to the surface of plate 93 so that the mechanism does not scar the equipment to which it is attached.

The insertion of locking device 28 into the exterior wall 137 of a piece of equipment is illustrated by way of reference to FIGS. 13 A and B. Wall 136 has a slot 138, which is identical to the slot 72 illustrated in FIG. 8. The peripheral dimensions of crossmember 124, and also those of pins 130 and shaft 122 in combination, are identical to the corresponding parts in FIGS. 6 and 7. Simply put, locking device 28 is designed to fit into the same slot as locking device 12.

Figure 13A:
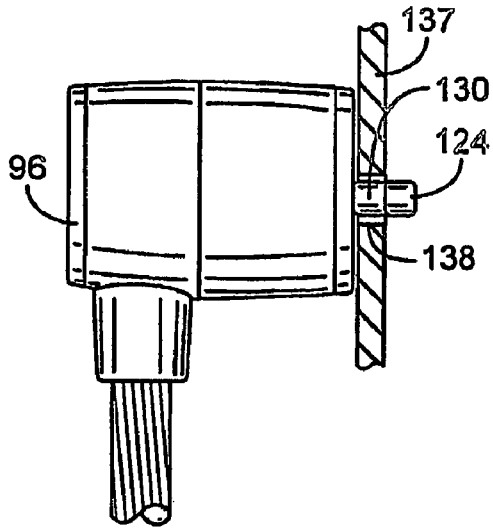
FIGS. 13A and 13B are side elevation views illustrating the installation of the locking device of FIG. 11 on an item of equipment.
Figure 10B:
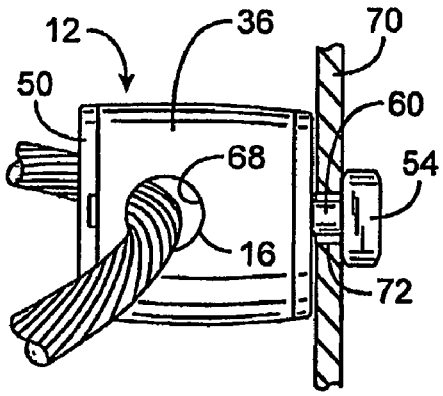
Figure 13B:
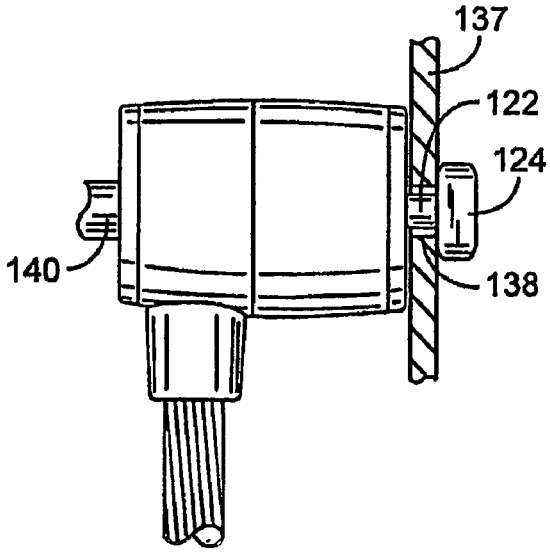

As illustrated in FIG. 13A, crossmember 124 is aligned with pins 30 so that the crossmember can be inserted into slot 138. When fully inserted, the space in the slot is essentially occupied by pins 130 and shaft 122. If necessary, plate 96 can be depressed to push the cylindrical portion 116 of spindle 114 against spring 132. Once crossmember 124 has been fully inserted through slot 138, a key 140 engaging lock mechanism 118 (see FIG. 12) is used to rotate the spindle 90° and misalign crossmember 124 and slot 138.

In operation, both locking device 12 and locking device 28 are attached to an item of computer or other equipment which has a specially designed slot 72, 138. First, the crossmember 54, 124 is aligned with the pins 60, 130, for insertion to the crossmember through the slot. The spindle 46, 114 is then rotated relative to the housing to misalign the crossmember 54, 124 relative to the slot. The spindle is locked in this configuration by passing the cable 18 through the mating slot 16, 48 in the first embodiment, or using the key 140 in the second embodiment. Either way, the locking device is extremely difficult to disengage by anyone not having the appropriate key 24, 140. Any unauthorized attempt to remove the locking device from the computer component will most likely result in significant damage to the computer housing, making the computer difficult to resell and greatly reducing its theft potential.

Figures 14, 15:
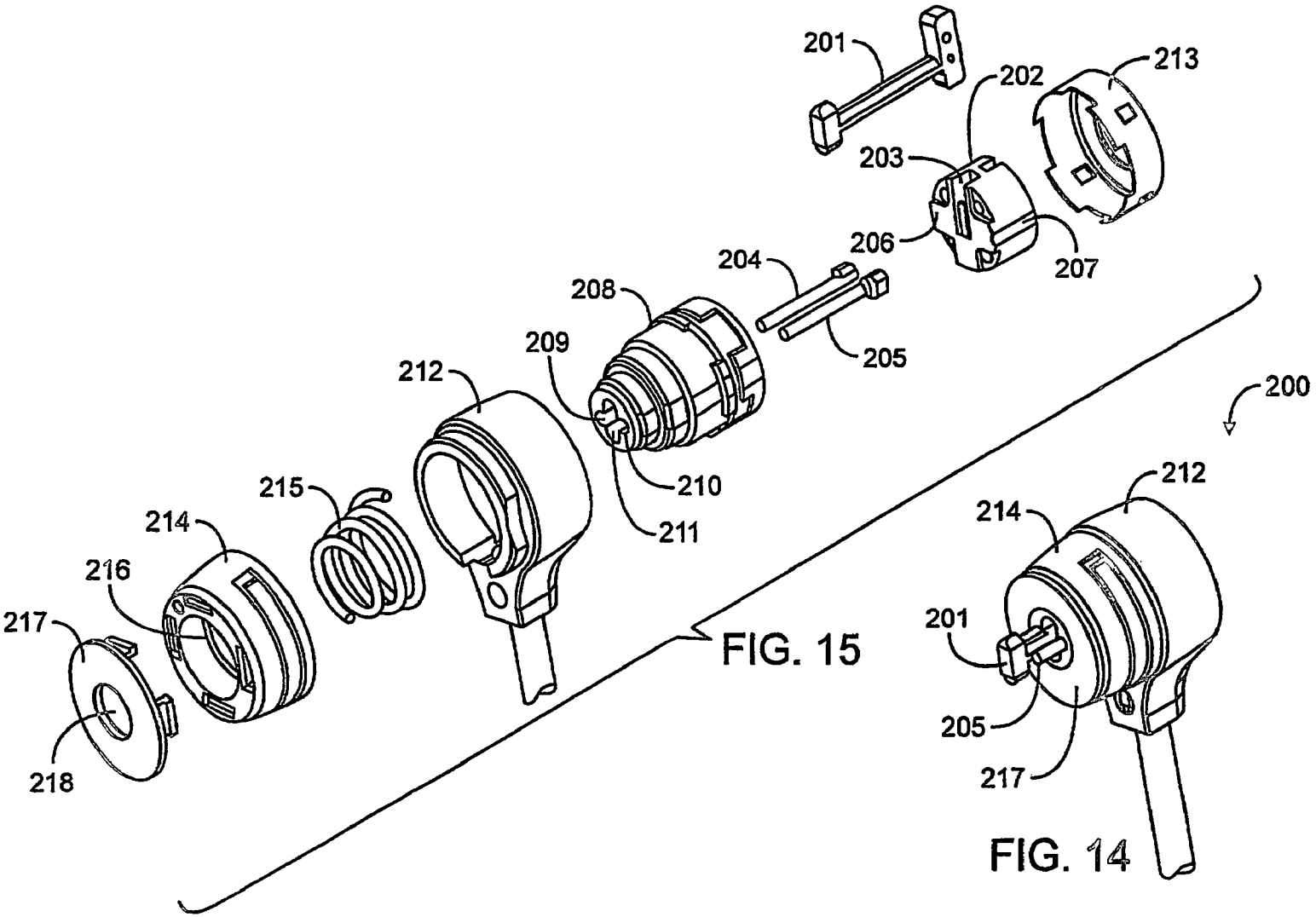
FIG. 14 is a perspective view of an example of a third embodiment of a locking device for a security device for use with the present invention.
FIG. 15 is an exploded view of the locking device of FIG. 14.

FIGS. 14 and 15 illustrate another embodiment of an locking device 200 for use with the present invention. A crossmember 201 is held in shell 202 in slot 203 by collar 208. Two pins 204, 205 are held in shell 202 in slots 206, 207, respectively, by collar 208. The two pins extend through apertures 209, 210, respectively, while crossmember 201 extends through aperture 211. A cylindrical collar 212 circumscribes the outer portion of collar 208. A rear cover 213 is also held in place by cylindrical collar 212. A nose-piece 214 engages a front portion of cylindrical collar 212 while collar 208 is spring biased by spring 215 against an inner portion of nose-piece 214 such that ends of the pins and crossmember extend through aperture 216 defined within nose-piece 214. A bushing 217 is coupled to a front portion of nose-piece 214 such that ends of the pins and crossmember extend through aperture 218. Bushing 217 is preferably made of plastic or other non-abrasive material so that locking device 200 does not scar the equipment to which it is attached.

Figure 16:
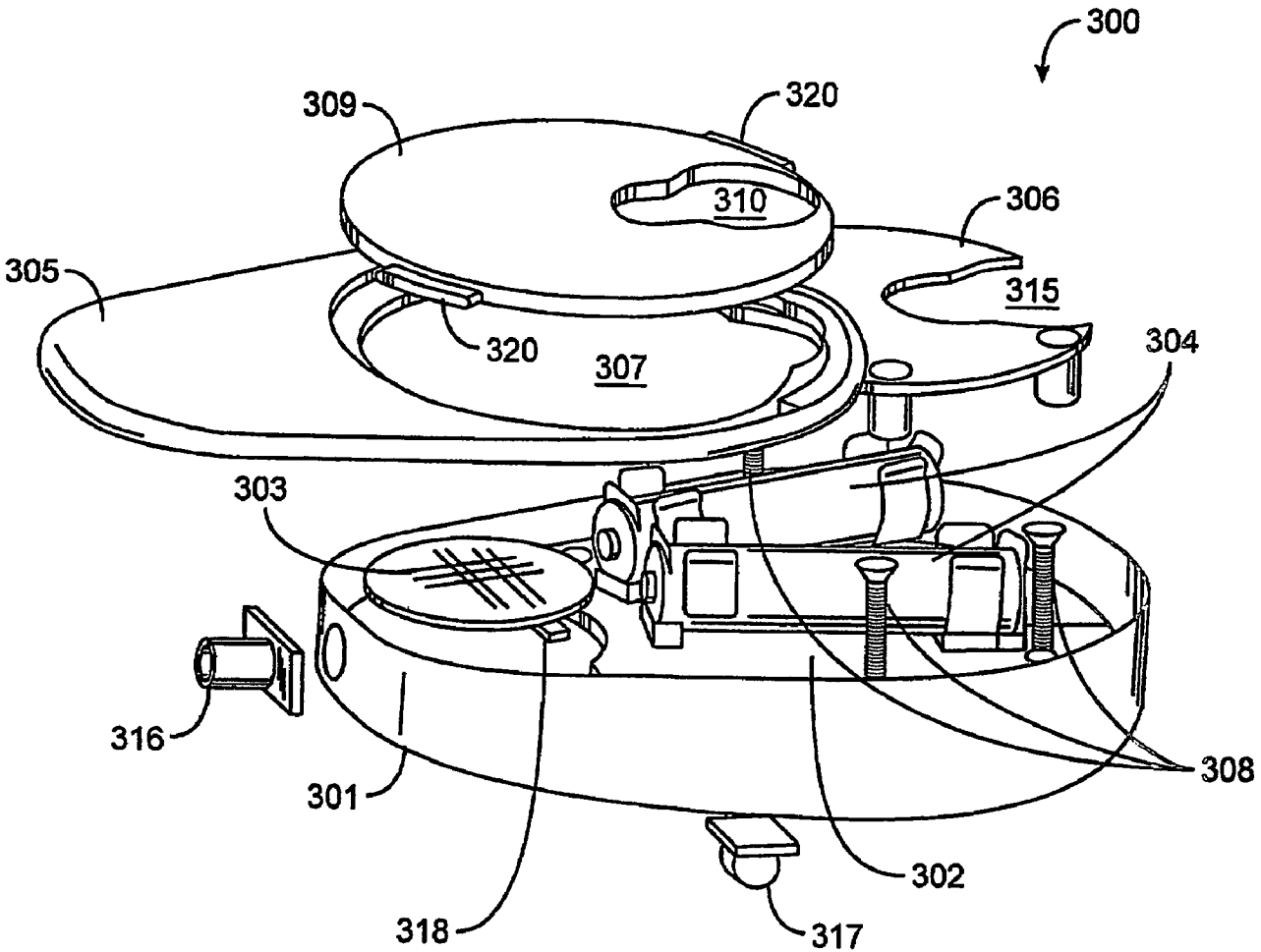
FIG. 16 is an exploded view of an alarm for use with a security device in accordance with the present invention.

FIG. 16 illustrates an alarm system 300 for use with a security device as previously discussed. The alarm system replaces closed loop 34 and works in a similar manner for physically securing electronic devices. The alarm includes a main housing 301 and a printed circuit board (PCB) 302 mounted therein. An alarm 303, preferably a 27 mm piezo is coupled to the PCB. A power source 304, preferably two AAA batteries, is coupled to the PCB. A cover plate 305 is placed over the main housing and a mid-plate 306 is placed over an opening 307 defined therein. Preferably, the cover plate and housing are sonic welded together. Preferably, three screws 308 are used to hold the mid-plate in place. A lock plate 309 is then placed over the mid-plate. Lock plate 309 includes flanges 320 that cooperate with notches 321 defined within cover plate 305.

Figure 17:
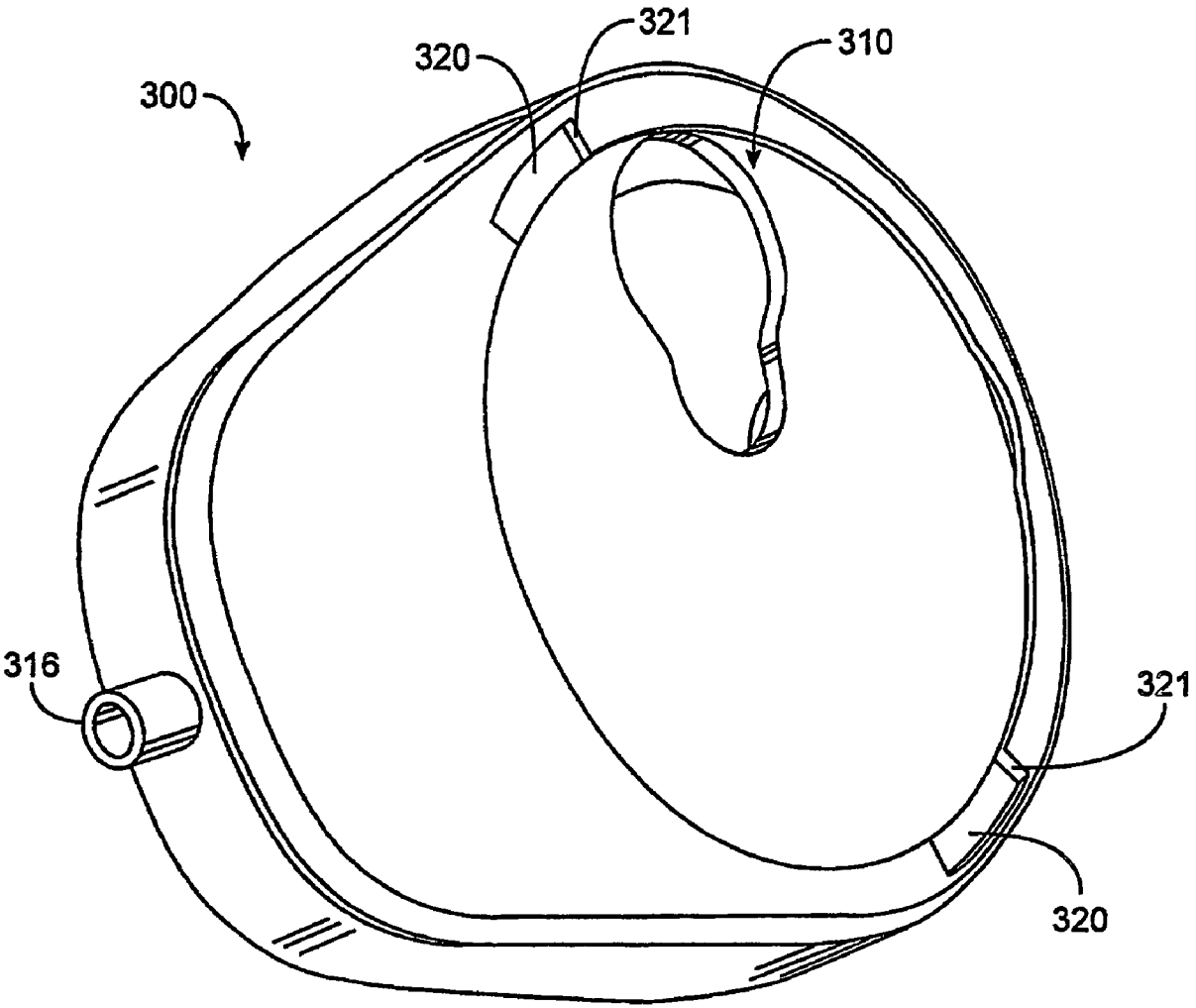
FIG. 17 is a perspective view of the alarm illustrated in FIG. 16 with a lock plate ready for removal.
Figure 18:
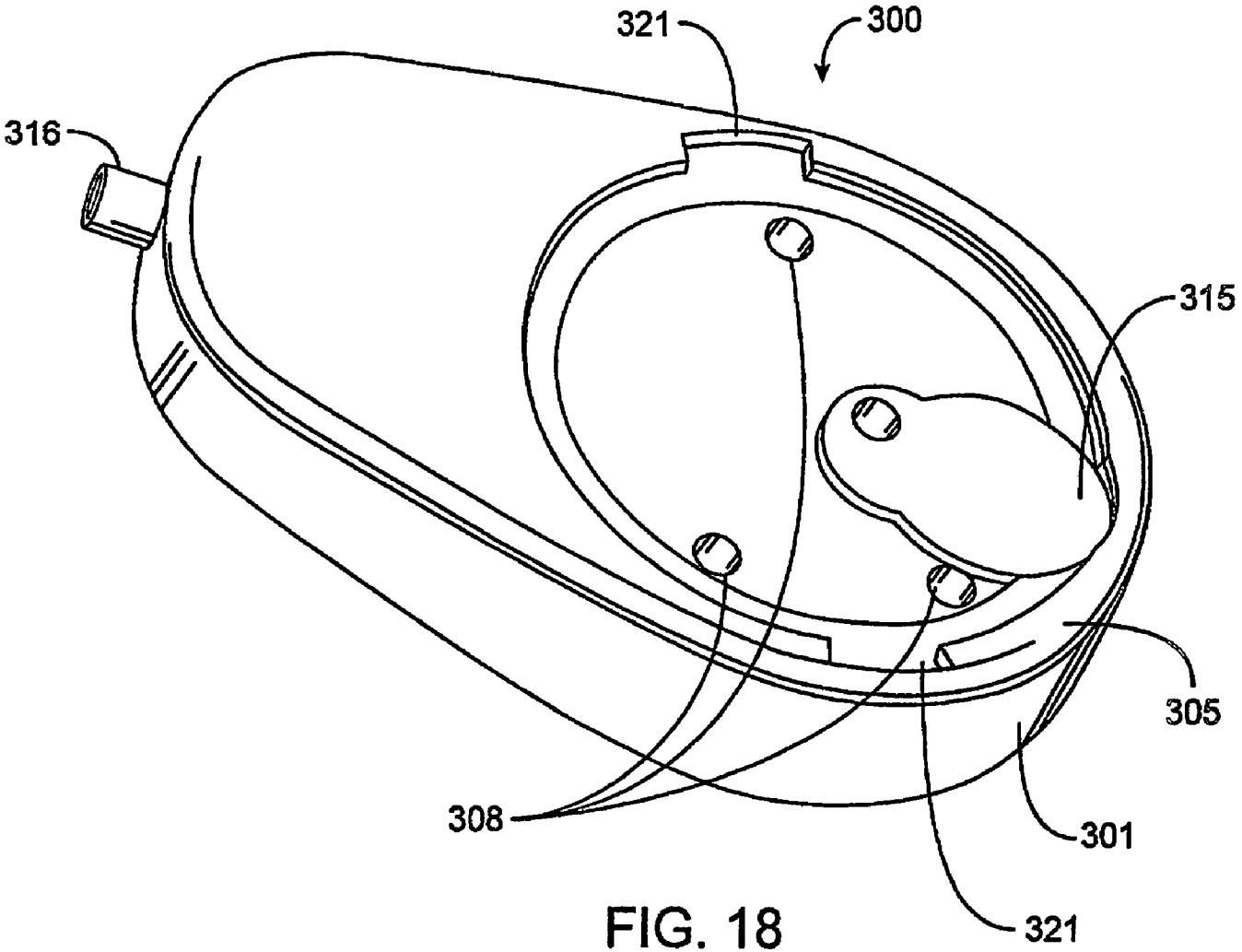
FIG. 18 is a perspective view of the alarm illustrated in FIG. 17 with the lock plate removed.
Figure 19:
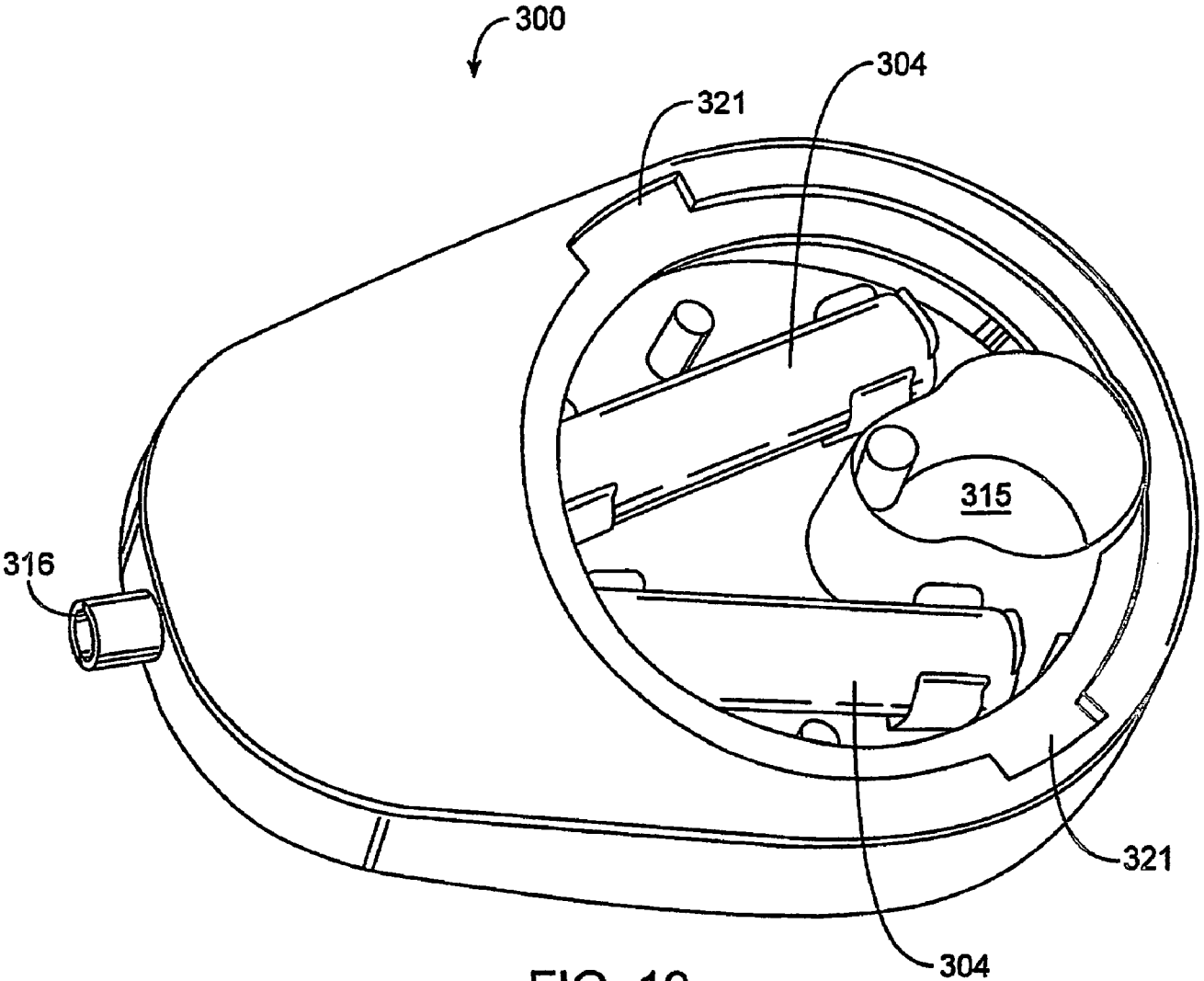
FIG. 19 is a perspective view of the alarm illustrated in FIG. 18 with screws and a mid-plate removed, thereby allowing access to the alarm's power source.

As can be seen in FIGS. 17–19, the lock plate includes an opening 310 defined therein. This opening aligns with a similarly shaped passage 315 defined through the alarm. This allows for passage of the security device and cable therethrough. When the opening in the lock plate is aligned with the opening of the alarm, the lock plate cannot be removed because the flanges are not aligned with notches 321. Thus, when the cable is run through the aligned openings, the lock plate cannot be moved and thus, the flanges cannot be aligned with the notches, thereby preventing access to the mid-plate. Accordingly, one cannot access the power source. The mid-plate is provided for extra protection and thus, is not required if it is not desired. When the cable is removed, the lock plate may be moved so that the flanges align with the notches and the lock plate may be removed.

Cable 32 is preferably coupled in a suitable manner to the alarm system with an insert molded ferrule 316 that couples the cable to the main housing. The cable includes an insulated wire loop (not shown) running therethrough. The insulated wire loop is thus in communication with the PCB through the ferrule. This completes the circuit. If the cable is cut, and hence the wire loop is cut, the circuit is broken and the alarm will sound. A single pill key 317 is also preferably provided on a bottom portion of the main housing and is used for testing of the alarm.

Figure 20:
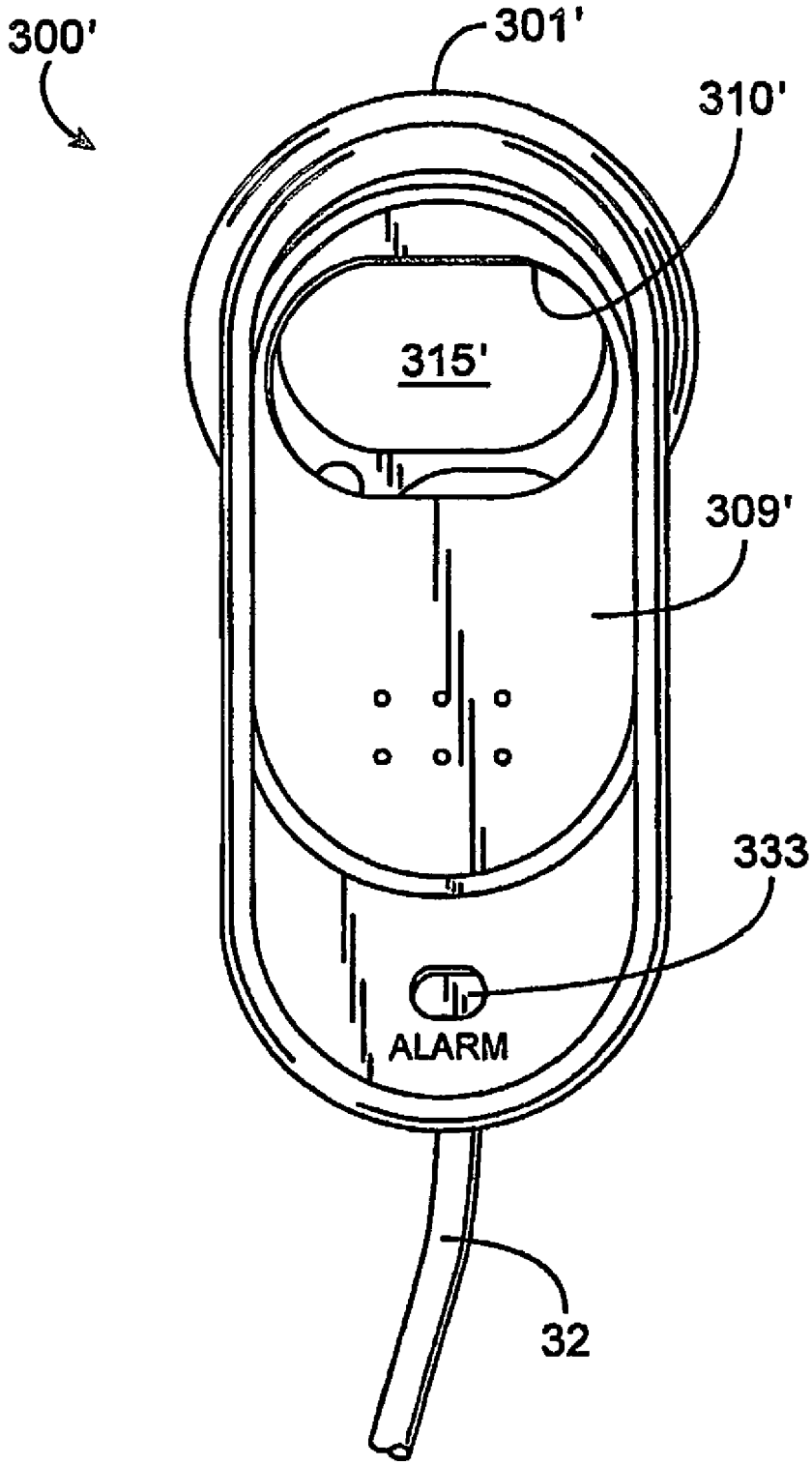
FIG. 20 is a front elevation view of an alternative embodiment of an alarm for use with a security device in accordance with the present invention with a lock plate partially moved to begin misaligning openings.
Figure 21:
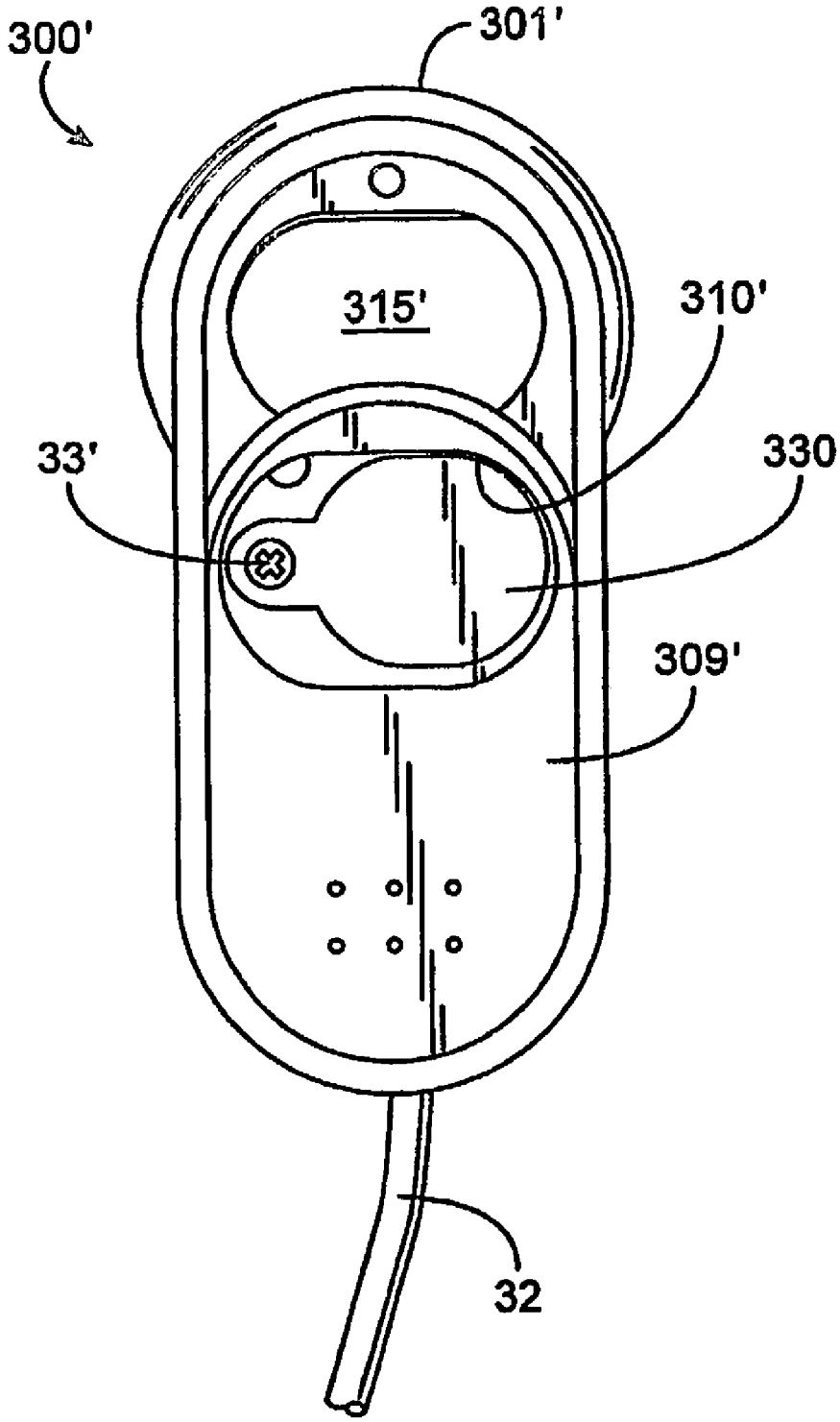
FIG. 21 is a front elevation view of the alternative embodiment of an alarm for use with a security device in accordance with the present invention with the lock plate fully moved to misalign the openings.
Figure 22:
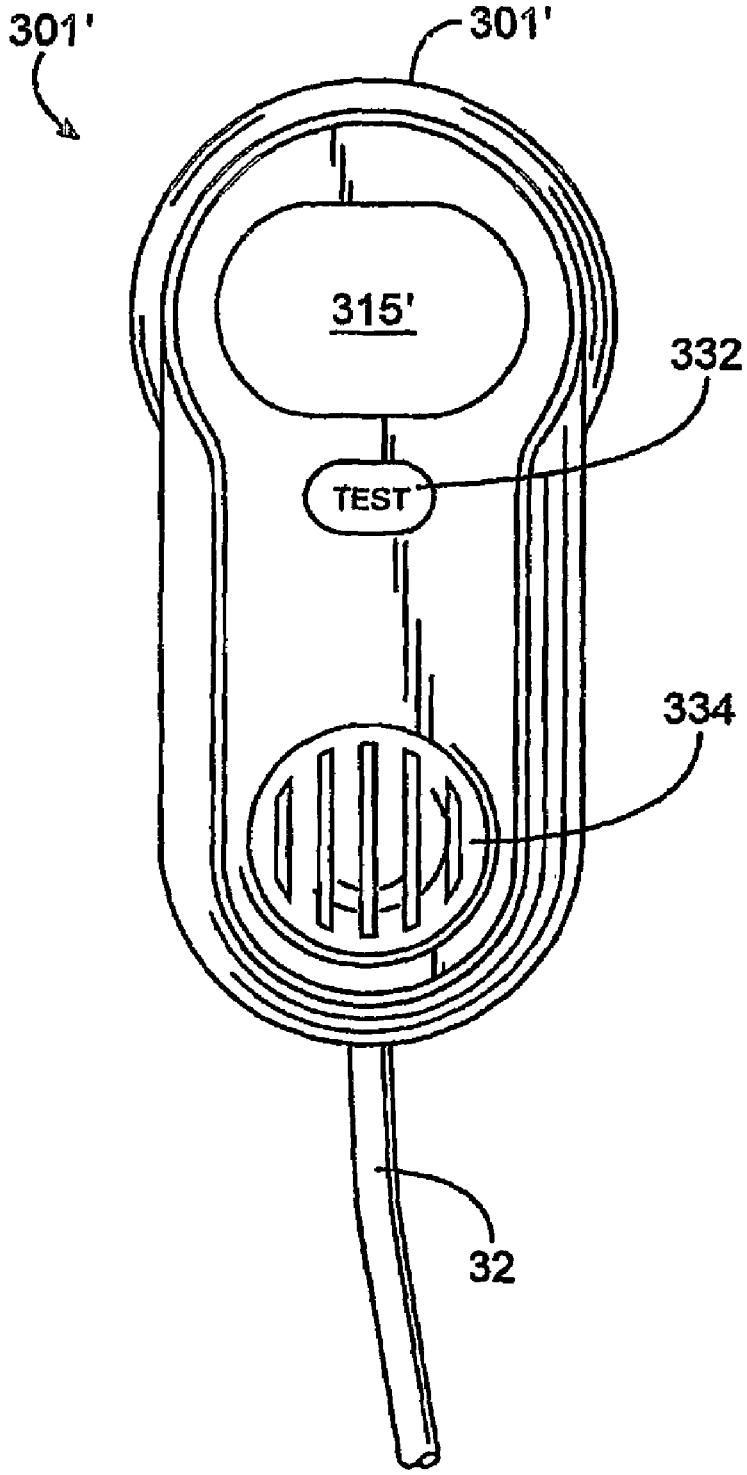
FIG. 22 is a back elevation view of the alternative embodiment of an alarm for use with a security device in accordance with the present invention.

FIGS. 20–22 illustrate another embodiment of an alarm system 300' for use with a security device as previously discussed. Alarm system 300' is similar to alarm system 300 as previously described. However, alarm system 300' includes a lock plate 309' that includes an opening 310' defined therein. Opening 310' aligns with a similarly shaped passage 315' defined through the alarm. This allows for passage of the security device and cable therethrough.

As may be seen in FIGS. 20 and 21, lock plate 309' slides relative to the main portion or housing 301' of the alarm. When the openings of the lock plate and the alarm are aligned, the security device and cable may pass therethrough. When the openings are allowed in, lock plate 309' prevents access to door 330. Door 330 is preferably coupled to the alarm to one or more screws 33'. Removal of door 330 allows access to the batteries. Thus, door 330 is only accessible when the openings of the door plate and the passage of the alarm are misaligned. This prevents removal of the batteries, and thereby defeating the alarm, when the alarm is in use. Preferably, a test button 332 is provided for testing the alarm.

Preferably, the alarm is always on and thus, there is no need for an on/off switch. Additionally, no user interaction is required to arm the alarm in this situation. However, an on/off switch may be provided if desired so that the alarm may be turned off when desired. Additionally, the alarm may be configured so that when lock plates 309, 309' are positioned such that the openings are misaligned, the alarm is off or deactivated.

In a preferred embodiment, a surface-mount LED 333 is included. The LED may indicate that the battery or power source is low based upon its brightness, or due to it not being lit. The LED warns potential thieves that the alarm is operational. Preferably, the alarm chirps when the battery is low (similar to a smoke detector) through speaker grate 334. An LED may be provided with the embodiment illustrated in FIGS. 16–19 if desired. Likewise, the alarm preferably chirps when the battery is low with the embodiment illustrated in FIGS. 16–19.

Thus, the batteries may only be removed when the lock is not connected to a portable electronic device, i.e., the cable is not looped through the hole defined within the lock plate and the alarm housing. Finally, even if the alarm is defeated (e.g., destroyed with a hard device such as a hammer) the cable is still looped such that the portable electronic device is coupled to some secondary object.

Thus, in use, the lock plate is aligned so that the opening defined therein is aligned with the passage defined within the alarm. The security device and cable is routed or "wrapped" around an immovable object, such as a post, desk leg, etc. The security device then passes through the aligned openings and the cable then also extends through the aligned openings. The security device is then coupled and locked to an electronic device as described above, depending upon the security device embodiment. Thus, the electronic device is now secured to an immovable object. Either the security device must be broken and removed from the electronic device, or the cable must be cut. However, if the cable is cut, the alarm will sound. Preferably, the alarm is always on.

The above-described arrangements of apparatus and methods are merely illustrative of applications of the principles of this invention and many other embodiments and modifications may be made without departing from the spirit and scope of the invention as defined in the claims.

What is claimed is:

1. A security device for preventing removal of an electronic device, the security device comprising:

a cable;

a locking device at a distal end of the cable; and, an alarm coupled to a proximal end of the cable, the alarm comprising a housing including a passage defined therethrough, a power source, and a movable lock plate over the power source and including an opening defined therein;

wherein when the passage and the opening are aligned and when the cable is routed through the passage and the opening, the lock plate cannot be removed and thus, the power source is inaccessible; and wherein a wire loop is included within the cable and is coupled to the alarm such that if the cable is cut, the alarm sounds.

2. A security device in accordance with claim 1 wherein the lock plate slides relative to the housing.

3. A security device in accordance with claim 1 wherein the lock plate rotates relative to the housing.

4. A security device in accordance with claim 1 wherein the alarm is active continuously.

5. A security device in accordance with claim 1 wherein the power source comprises batteries and the alarm further comprises a battery level indicator.

6. A security device in accordance with claim 5 wherein the battery level indicator comprises at least one LED.

7. A security device in accordance with claim 5 wherein the battery level indicator produces a sound emission.

8. A security device in accordance with claim 1 wherein the locking device is configured for coupling to a security slot defined with a wall of the electronic device.

9. A security device in accordance with claim 8 wherein the security slot has dimensions of 3 mm by 7 mm.

10. A security device for preventing removal of an electronic device that includes a security slot having dimensions of approximately 3 mm by 7 mm, the security device comprising:

a cable;

a locking device at a distal end of the cable that includes a movable locking member for insertion into the security slot; and, an alarm coupled to a proximal end of the cable, the alarm comprising a housing including a passage defined therethrough, a power source, and a movable lock plate over the power source and including an opening defined therein;

wherein when the passage and the opening are aligned and when the cable is routed through the passage and the opening, the lock plate cannot be removed and thus, the power source is inaccessible; and wherein a wire loop is included within the cable and is coupled to the alarm such that if the cable is cut, the alarm sounds.

11. A security device in accordance with claim 10 wherein the lock plate slides relative to the housing.

12. A security device in accordance with claim 10 wherein the lock plate rotates relative to the housing.

13. A security device in accordance with claim 10 wherein the alarm is active continuously.

14. A security device in accordance with claim 10 wherein the power source comprises batteries and the alarm further comprises a battery level indicator.

15. A security device in accordance with claim 14 wherein the battery level indicator comprises at least one LED.

16. A security device in accordance with claim 14 wherein the battery level indicator produces a sound emission.

17. A method of securing an electronic device with a security device comprising an alarm including a housing, a cable coupled to the housing and including a wire therein for completing an alarm circuit, and a locking device coupled a distal end of the cable, the method comprising:

aligning an opening defined within a lock plate of the alarm with an opening defined within the housing;

passing the cable around a secondary object;

passing the locking device through the aligned openings;

inserting a locking member of the locking device into a security slot defined within the portable electronic device;

misaligning the locking member with respect to the security slot into a locked position such that it cannot be removed from the security slot; and maintaining the locking member in the locked position with at least one pin.

* * * * *